US007931016B2

(12) United States Patent
Funaki

(10) Patent No.: US 7,931,016 B2
(45) Date of Patent: Apr. 26, 2011

(54) PAPER BULLET FIRING PISTOL TOY

(75) Inventor: Shotaro Funaki, Tokyo (JP)

(73) Assignee: Agatsuma Co., Ltd., Tokyo (JP)

( * ) Notice: Subject to any disclaimer, the term of this patent is extended or adjusted under 35 U.S.C. 154(b) by 0 days.

(21) Appl. No.: 12/689,537

(22) Filed: Jan. 19, 2010

(65) Prior Publication Data

US 2010/0180878 A1 Jul. 22, 2010

(30) Foreign Application Priority Data

Jan. 20, 2009 (JP) ..... 2009-009584

(51) Int. Cl.
*F41B 11/00* (2006.01)
*F41B 11/14* (2006.01)

(52) U.S. Cl. ..... 124/66

(58) Field of Classification Search ..... 124/66–69; 446/181, 182
See application file for complete search history.

(56) References Cited

U.S. PATENT DOCUMENTS 2,490,991 A * 12/1949 Langos ..... 446/182
2,634,548 A * 4/1953 Langos ..... 446/182
2,634,549 A * 4/1953 Langos ..... 446/182
2,634,550 A * 4/1953 Langos ..... 446/182
2,637,941 A * 5/1953 Langos ..... 446/182
6,669,530 B2 * 12/2003 Du ..... 446/475

* cited by examiner

*Primary Examiner* — Troy Chambers
(74) *Attorney, Agent, or Firm* — The Marbury Law Group PLLC

(57) ABSTRACT

A paper bullet firing pistol toy produces its own projectiles sequentially for shooting. By sliding an operating part on the outside of the toy, a strip of paper is drawn into the body of the pistol, and a piece of the paper is cut and folded into a bullet shape inside the toy. Thereafter, the paper bullet is shot from the muzzle by operating the trigger part, and the toy's mechanisms can be restored to their initial states by restoring the sliding operating part to its initial position, thereby making it possible to shoot paper bullets continuously.

4 Claims, 9 Drawing Sheets

(a)

(b)

PAPER BULLET FIRING PISTOL TOY

CROSS-REFERENCE TO RELATED APPLICATIONS

This application is based upon and claims the benefit of priority from the prior Japanese Patent Application No. 2009-009584 filed on Jan. 20, 2009, the entire contents of which, including the description, claims, drawings, and abstract thereof, are incorporated herein by reference.

BACKGROUND OF THE INVENTION

1. Field of the Invention

The present invention relates to a paper bullet firing pistol toy which fires a projectile by air pressure, and more particularly to a paper bullet firing pistol toy which fires a bullet produced in a firing preparation operation.

2. Background Art

There have conventionally been proposed various air pistol toys which shoot bullets by air pressure. For example, an invention of Japanese Unexamined Patent Publication No. 2002-13899 is an air pistol toy including a barrel part and a bolt in which a distal end side is inserted in the barrel part and a rear end side operating portion projects from a rear portion of the barrel part and which can operate in a reciprocating fashion in an axial direction of the barrel part, wherein a bullet made of rubber which is held in the vicinity of a muzzle which configures a distal end of the barrel part is shot from the muzzle by pushing in another bullet made of rubber which is loaded in a position rearwards of the bullet held in the vicinity of the muzzle by the bolt so as to increase the pressure of air residing between the two bullets, a bullet loading portion being provided on an outer circumference of the barrel part in a position spaced a predetermined distance apart from the muzzle towards the rear.

SUMMARY

A paper bullet firing pistol toy is provided which can produce projectiles sequentially for shooting. The paper bullet firing pistol toy includes a housing having a grip part, a barrel part fixed to the housing, an operating part which is disposed in such a manner as to move in a longitudinal direction relative to the housing, a trigger part which is connected rotatably, a paper feeding mechanism which has rollers for holding a strip of paper on an axis center of the barrel part and a roller rotating means, a paper cutting mechanism which has a crown-shaped cutting blade disposed in such a manner as to come into contact with and go away from the paper held by the rollers and a pressing member for pressing the cutting blade, a forcible air discharging mechanism which has a cylinder fixed on the axis center of the barrel part, a piston disposed in such a manner as to move in the longitudinal direction within the cylinder and an elastic member for biasing the piston to the front, a paper drawing mechanism which has a distal end portion of a circular cylindrical tube which extends towards the front from the cylinder and a bore portion of the barrel part into which the distal end portion is fitted, and a locking mechanism for locking the piston against an elastic force of the elastic member.

DETAILED DESCRIPTION

Figure 1:
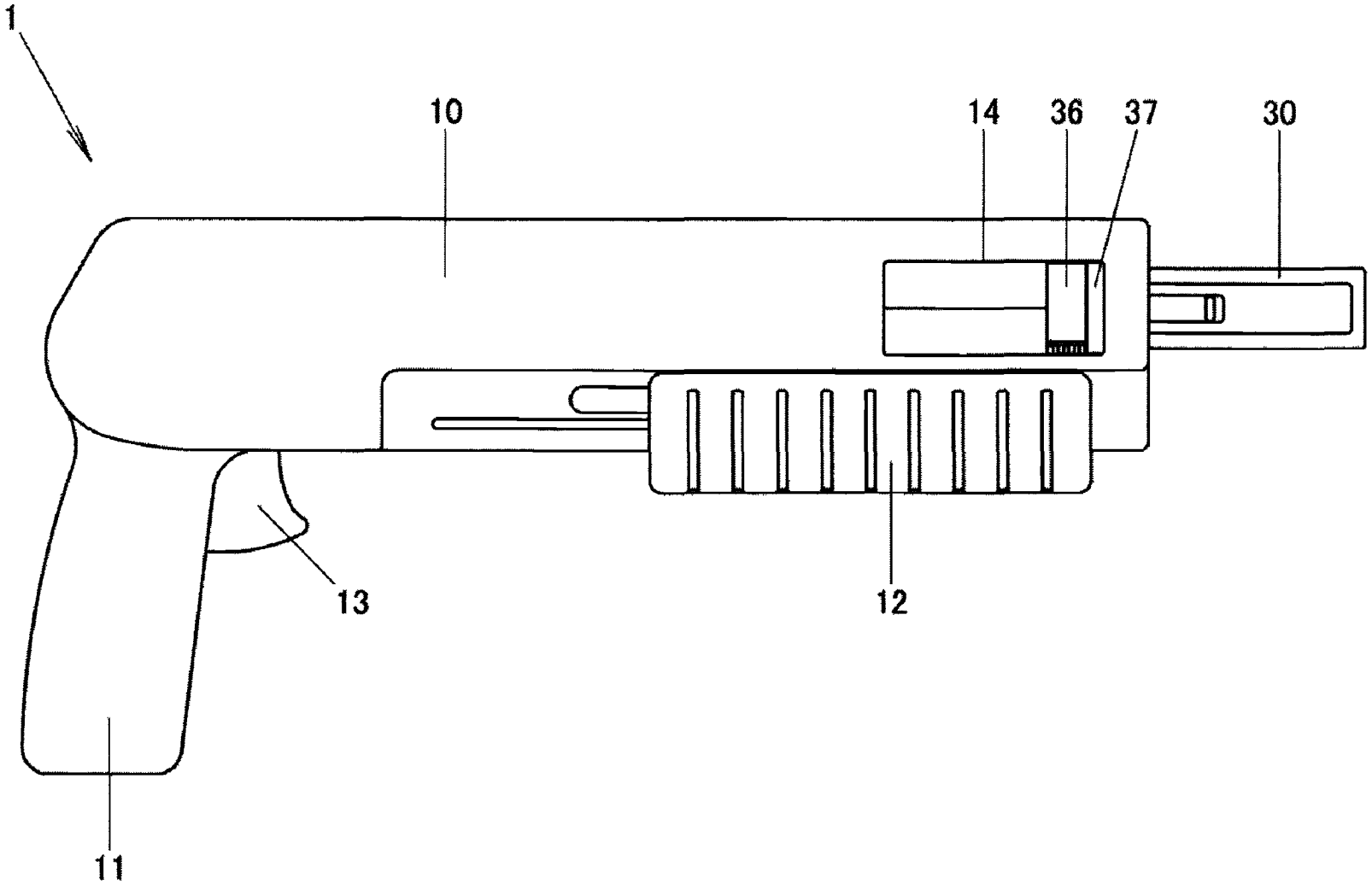
FIG. 1 is a side view of a paper bullet firing pistol toy according to an embodiment of the invention.

Although the invention of Japanese Patent Publication No. 2002-13899 is configured so that a bullet made of rubber can be loaded in the barrel part as a projectile without removing the bolt from the barrel part, since a ready-made projectile needs to be loaded before shooting is carried out, formed projectiles have had to be prepared in advance.

In addition, although various air pistol toys have conventionally been invented which can shoot ready-made plastic spherical projectiles or disk-shaped projectiles, an air pistol toy has never been invented which produces projectiles by itself, and a novel air pistol toy has been in demand.

The current invention has been made in view of the problem inherent in the related art, and an object thereof is to provide a paper bullet firing pistol toy which can produce its own projectiles of paper sequentially to be fired.

A paper bullet firing pistol toy of the invention includes a housing having a grip part, a barrel part fixed to a front end of the housing, an operating part which is disposed at a front lower portion of the housing in such a manner as to move in a longitudinal direction relative to the housing, a trigger part which is connected rotatably to the vicinity of the grip part, a paper feeding mechanism which has rollers which are disposed in the vicinity of a front end of the housing for holding a strip of paper on an axis center of the barrel part and a roller rotating means for rotating the rollers, a paper cutting mechanism which has a crown-shaped cutting blade disposed in such a manner as to move in the longitudinal direction relative to the paper held on the axis center of the barrel part by the rollers so as to come into contact with and go away from the paper and a pressing member for pressing the cutting blade, a forcible air discharging mechanism which has a circular cylindrical cylinder fixed on the axis center of the barrel part, a piston disposed in such a manner as to move in the longitudinal direction within the cylinder and an elastic member for biasing the piston to the front, a paper drawing mechanism which has a distal end portion of a circular cylindrical tube which extends towards the front from the cylinder and a bore portion of the barrel part into which the distal end portion is fitted, and a locking mechanism for locking the piston against an elastic force of the elastic member, wherein the paper is moved in a direction which is perpendicular relative to the axis center of the barrel part by the paper feeding mechanism by moving the operating part to the rear so that the paper is disposed on the axis center of the barrel part, the paper disposed on the axis center of the barrel part is cut by the paper cutting mechanism, a projectile is produced by bending inwards an outer circumferential portion of the paper so cut by the paper drawing mechanism, and the piston of the forcible air discharging mechanism is locked by the locking mechanism against the elastic force of the elastic member, wherein the locked state of the piston is released by rotating the trigger part so that the piston is caused to be inserted into the cylinder by virtue of the elastic force of the elastic member so as to spray air residing within the cylinder against the projectile to thereby shoot the projectile from a distal end of the barrel part, and wherein the respective mechanisms are restored by moving the operating part to the front.

The locking mechanism is configured in such a manner as not only to lock the piston but also to lock the operating part, so as to release the locked states of the piston and the operating part individually.

The piston is a circular cylindrical piston including one closed end as a piston head portion, a disk-shaped ring mounting plate being secured to the piston head portion. The ring mounting plate is formed in such a manner that an outside diameter of a rear portion becomes smaller than a front portion, so that when secured to the piston head portion, a ring groove is formed between the piston head portion and the front portion of the ring mounting plate and includes a through hole communicating with the ring groove, and an O ring is disposed slidably in the ring groove. In addition, in this paper bullet firing pistol toy, when the O ring is closely attached to the piston head portion, a space between the cylinder and the piston is sealed by the O ring, while when the O ring is closely attached to the front portion of the ring mounting plate, the space between the cylinder and the piston and the through hole are made to communicate with each other, so that air is allowed to flow into the space between the cylinder and the piston.

According to the invention, the paper bullet firing pistol toy can be provided in which the paper bullet is produced and held in the bore portion by the paper feeding mechanism, the paper cutting mechanism, the paper drawing mechanism and forcible air discharging mechanism performing the series of operations by operating the operating part, air residing within the cylinder is compressed and jetted by the piston against the projectile held in the bore portion to thereby shoot the paper bullet from the muzzle by releasing the locked state of the forcible air discharging mechanism by the locking mechanism, and the respective mechanisms by operating the trigger part are restored by returning the operating part to the initial position so as to enable the sequential shooting of paper bullets.

In addition, since the locking mechanism locks the operating part, the releasing operation can easily be performed. Further, since the locking mechanism is configured so that the releasing operation of the locked state of the piston and the releasing operation of the locked state of the operating part are executed at different timings, the operating part can be prevented from moving at the same time as the piston operates due to both the locked states being released at the same time or the operating part being not locked, so as to jet a stream of air against the paper bullet with good efficiency to thereby shoot the paper bullet from the muzzle.

In addition, by forming the ring groove in which the O ring can slide between the front portion of the piston mounting plate and the piston head portion and forming the through hole which communicates with the ring groove in the ring mounting plate which is secured to the piston head portion, when the piston is moved to the rear, the O ring moves to the front relative to the piston by virtue of friction with an inner circumferential surface of the cylinder so as to be closely attached to the ring mounting plate, whereby the communication is established between the cylinder and the piston by the through hole, thereby making it possible to facilitate the rearward movement of the piston. In addition, when the piston is pushed out to the front, the O ring moves to the rear relative to the piston due to friction with the inner circumferential surface of the cylinder so as to be closely attached to a front end of the piston head portion of the piston, whereby the space between the cylinder and the piston is sealed, thereby making it possible to jet air against the paper bullet with good efficiency.

Description of Reference Numerals used in the figures and the descriptions: 1 paper bullet firing pistol toy; 2 main operating member; 3 bullet forming part; 4 paper feeding mechanism; 5 forcible air discharging mechanism; 6 paper drawing mechanism; 7 paper cutting mechanism; 8 locking mechanism; 10 housing; 11 grip part; 12 operating part; 12*a* shaft; 13 trigger part; 13*a* engagement projecting portion; 14 opening; 15 coil spring; 16 support plate; 17 sliding opening; 20 inserting attachment portion; 21 connecting portion; 22 pawl; 22*a* hook portion; 23 projection; 24 piston pushing portion; 25 first locking portion; 26 second locking portion; 26*a* hook portion; 26*b* plate spring; 27 base portion; 28 extending portion; 29 sliding piece; 30 barrel part; 31 locking plate; 31*a* engagement claw; 32 connecting post; 33 projection; 35 geared ratchet; 35*a* first gear; 36 geared roller; 36*a* second gear; 37 roller; 37*a* operating projection; 38 reverse rotation preventive plate; 39 case; 39*a* insertion port; 40 fixing tube; 41 cutting blade; 42 coil spring; 43 holding tube; 43*a* engagement plate; 45 pressing member; 45*a* engagement portion; 45*b* plate spring; 50 cylinder; 50*a* air discharging port; 51 piston; 51*a* piston head portion; 52 airway tube; 53 paper push-out portion; 54 O ring; 55 ring mounting plate; 56 ring groove; 57 through hole; 58 receiving portion; 59 coil spring; 60 guiding slope; 61 bore portion; 62 large diameter portion; 63 small diameter portion; 64 auxiliary small diameter portion; 100 paper; 101 cut paper; 101*a* projectile.

A paper bullet firing pistol toy 1 includes a housing 10 having a grip part 11, a barrel part 30 fixed to a front end of the housing 10, an operating part 12 which is disposed at a front lower portion of the housing 10 in such a manner as to move in a longitudinal direction relative to the housing 10, a trigger part 13 which is connected rotatably to the vicinity of the grip part 11, a paper feeding mechanism 4 which has a geared roller 36 and a roller 37 which are disposed in the vicinity of a front end of the housing 10 in such a manner as to confront the geared roller 36 for holding a strip of paper 100 on an axis center of the barrel part 30 and a roller rotating means for rotating the rollers 36, 37, a paper cutting mechanism 7 which has a crown-shaped cutting blade 41 disposed in such a manner as to move in the longitudinal direction relative to the paper 100 held on the axis center of the barrel part 30 by the rollers 36, 37 so as to come into contact with and go away from the paper and a pressing member 45 for pressing the cutting blade 41, a forcible air discharging mechanism 5 which has a circular cylindrical cylinder 50 fixed on the axis center of the barrel part 30, a piston 51 disposed in such a manner as to move in the longitudinal direction within the cylinder 50 and a coil spring 59 which is an elastic member for biasing the piston 51 to the front, a paper drawing mechanism 6 which has a paper push-out portion 53 which is a distal end portion of an airway tube 52 which is a circular cylindrical tube which extends towards the front from the cylinder 50 and a bore portion 61 of the barrel part 30 into which the paper push-out portion 53 is fitted, and a locking mechanism 8 for locking the piston 51 against an elastic force of the coil spring 59.

In addition, in this paper bullet firing pistol toy 1, the paper 100 is moved in a direction which is perpendicular relative to the axis center of the barrel part 30 by the paper feeding mechanism 4 by moving the operating part 12 to the rear so that the paper 100 is disposed on the axis center of the barrel part 30, the paper 100 disposed on the axis center of the barrel part 30 is cut by the paper cutting mechanism 7, a projectile 101*a* is produced by bending inwards an outer circumferential portion of the cut paper 101 so cut by the paper drawing mechanism 6, the piston 51 of the forcible air discharging mechanism 5 is locked by the locking mechanism 8 against the elastic force of the coil spring 59, the locked state of the piston 51 is released by rotating the trigger part 13 so that the piston 51 is caused to be inserted into the cylinder 50 by virtue of the elastic force of the coil spring 59 so as to spray air residing within the cylinder 50 against the projectile 101*a* to thereby shoot the projectile 101*a* from a distal end of the barrel part 30, and the respective mechanisms 4 to 8 are restored by moving the operating part 12 to the front.

In addition, the locking mechanism 8 is configured in such a manner as not only to lock the piston 51 but also to lock the operating part 12, so as to release the locked states of the piston 51 and the operating part 12 individually.

Further, the piston 51 is a circular cylindrical piston 51 including one closed end as a piston head portion 51*a*, a disk-shaped ring mounting plate 55 being secured to the piston head portion 51*a*, the ring mounting plate 55 is formed in such a manner that an outside diameter of a rear portion becomes smaller than a front portion, so that when secured to the piston head portion 51*a*, a ring groove 56 is formed between the piston head portion 51*a* and the front portion of the ring mounting plate 55 and includes a through hole 57 communicating with the ring groove 56, and an O ring 54 is disposed slidably in the ring groove 56. In addition, in this paper bullet firing pistol toy 1, when the O ring 54 is closely attached to the piston head portion 51*a*, a space between the cylinder 50 and the piston 51 is sealed by the O ring 54, while when the O ring 54 is closely attached to the front portion of the ring mounting plate 55, the space between the cylinder 50 and the piston 51 and the through hole 57 are made to communicate with each other, so that air is allowed to flow into the space between the cylinder 50 and the piston 51.

Hereinafter, an embodiment of the invention will be described based on the drawings. FIG. 1 is a side view of a paper bullet firing pistol toy 1 according to an embodiment of the invention. As is shown in FIG. 1, this paper bullet firing pistol toy 1 includes a hollow housing 10 which imitates an external appearance of a pistol, a barrel part 30 which imitates a barrel (a barrel) which has in an interior thereof a passage through which a propelled projectile passes, an operating part 12 which imitates a forearm (fore-end) which is used for a shooting preparing operation, and a trigger part 13 which imitates a trigger (a trigger) which executes a shooting operation.

The housing 10 is hollow and is formed by causing a left-hand housing and a right-hand housing which result by dividing the housing 10 into two halves on a transversely central plane of the housing 10 so that the divided two halves become substantially symmetrical with each other to confront each other and combining them together into an integral unit. In addition, this housing 10 has a grip part 11 which imitates a grip (a grip) which can be gripped on by a single hand at a rear lower portion thereof.

Further, the housing 10 has a rectangular opening 14 on left- and right-hand sides in the vicinity of a front end portion thereof. This opening 14 is formed in such a manner as to correspond to a longitudinal moving range of a geared roller 36 and a roller 37 which are disposed in the vicinity of a front end of the housing 10 for holding a strip of paper on an axis center of the barrel part 30. Namely, this opening 14 is formed in such a manner that since the strip of paper held between the geared roller 36 and the roller 37 is disposed in such a manner as to extend in a transverse direction, the paper is prevented from being held between the housing 10 and the rollers 36, 37, when the rollers 36, 37 move to the rear from an initial state position where the rollers 36, 37 are situated in the vicinity of a front end of the opening 14 or when the rollers 36, 37 move to the front so that the rollers 36, 37 are restored to the initial state from a state where the rollers 36, 37 are situated in the vicinity of a rear end of the opening 14 by the operations of the respective mechanisms disposed in the interior of the housing 10.

In addition, the barrel part 30 is fixed to the front end of the housing 10 in such a manner that its axial center becomes parallel to the longitudinal direction of the housing 10. In addition, the operating part 12 is disposed at a front lower portion of the housing 10 in such a manner as to slide in the longitudinal direction relative to the housing 10. Additionally, the trigger part 13 is connected rotatably to the vicinity of an upper front end of the grip part 11 so that it can be rotated to the rear by being operated to be pulled by the forefinger when the grip part 11 is gripped on.

Figure 2:
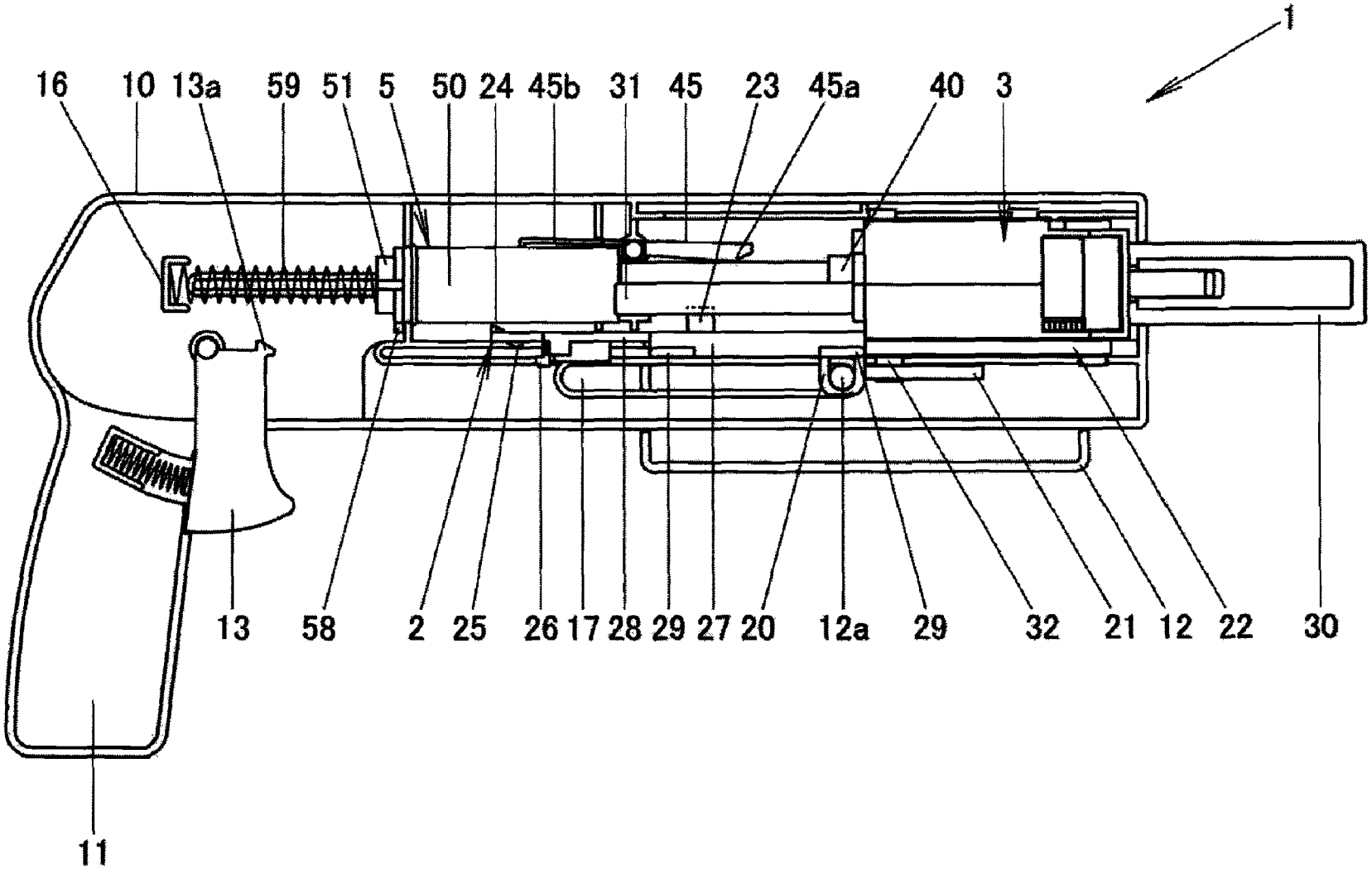
FIG. 2 is a side view of the paper bullet firing pistol toy according to an embodiment of the invention with the right-hand housing thereof removed.

Additionally, this paper bullet firing pistol toy 1 includes a paper feeding mechanism, a paper cutting mechanism, a paper drawing mechanism, a locking mechanism, and a forcible air discharging mechanism in the interior of the housing 10 and is configured in such a manner that a strip of paper for use in producing a new bullet every time a shooting operation is repeated is fed to be disposed on an axis center of the barrel part 30 by the paper feeding mechanism while the used paper is discharged, the paper disposed on the axis center of the barrel part 30 is cut into a circular shape by the paper cutting mechanism, further, the paper so cut is drawn to be made into a projectile which is a bullet by the paper drawing mechanism, and the projectile can be shot from a muzzle thereof by a stream of compressed air which is forcibly discharged by the forcible air discharging mechanism Next, referring to FIGS. 2 to 5, an interior construction and respective members of the paper bullet firing pistol toy 1 will be described. FIG. 2 is a side view of the paper bullet firing pistol toy 1 according to the embodiment of the invention with the right-hand housing removed. As is shown in FIG. 2, a main operating member 2 which operates in conjunction with the movement of the operating part 2 and a bullet forming part 3 which operates in conjunction with the movement of the main operating member 2 and the like are disposed in the housing 10 of the paper bullet firing pistol toy 1.

In addition, the main operating member 2 is disposed at a substantially central lower portion in the housing 10 in such a manner as to slide in the longitudinal direction and is connected to the operating part 12 by a shaft 12*a* which is disposed in the transverse direction at a substantially central upper end of the operating part 12 being inserted to be attached in place in an inserting attachment portion 20 which is formed in the vicinity of a front end of the main operating member 2, so as to move together with the operating part 12.

In addition, the bullet forming part 3 is disposed in the vicinity of the front end of the housing 10 in such a manner as to slide in the longitudinal direction and is connected to the main operating member 2 by a connecting post 32 which projects downwards from the vicinity of a rear end of the bullet forming part 3 being loosely inserted into a connecting portion 21 which is formed in the vicinity of the front end of the main operating member 2 and which has a substantially rectangular sliding groove.

In addition, a sliding opening 17 which runs lengthwise in the longitudinal direction is formed at a substantially central lower portion on the left- and right-hand sides of the housing 10, and the shaft 12*a* is loosely inserted in this sliding opening 17. By this, the operating part 12 is allowed to move in the longitudinal direction along the sliding opening 17. In addition, when the operating part 12 is disposed so that the shaft 12*a* of the operating part 12 is situated at a front end of the sliding opening 17 as is shown in the figure, the main operating member 2 and the bullet forming part 3 are also disposed at front ends of moving ranges thereof, resulting in an initial state.

Additionally, the forcible air discharging mechanism 5 which is made up of a circular cylindrical cylinder 50 and a circular cylindrical piston 51 which is closed at one end is disposed above the main operating member 2 and to the rear of the bullet forming part 3. In addition, the cylinder 50 is fixed to the housing 10, and the piston 51 is disposed in such a manner as to move in the longitudinal direction within the cylinder 50. Additionally, the piston 51 is biased to the front by a coils spring 59 which is an elastic member which is held by the piston 51 and a support plate 16 which is disposed in the vicinity of a rear end of the housing 10.

In addition, a substantially flat plate-shaped pressing member 45 which extends lengthwise in the longitudinal direction is mounted above the forcible air discharging mechanism 5 by a shaft. A front side of this pressing member 45 which lies forwards of the shaft is formed into an engagement portion 45*a* which is brought into engagement with a fixing tube 40 for fixing a cutting blade, which will be described later, so as to press the cutting blade via the fixing tube 40, and a rear side of the pressing member 45 which lies rearwards of the shaft is formed into a plate spring 45*b* which is a thin plate material having an L-shaped cross section and which can be deformed elastically.

Additionally, by a distal end of the plate spring 45*b* being brought into engagement with an outer circumferential upper surface of the cylinder 50, the engagement portion 45*a* is disposed in such a manner as to lie downwards relative to the plate spring 45*b*. In addition, a lower portion of a front side of this engagement portion 45*a* which is brought into engagement with the fixing tube 40 is formed as a flat plane which becomes perpendicular relative to the longitudinal direction of the housing 10, and a slope is formed from an upper end to a front end of the flat plane so as to be brought into engagement with a projection on a case of the bullet forming part 3, which will be described later.

In addition, in this paper bullet firing pistol toy 1, the paper feeding mechanism, the paper cutting mechanism, the paper drawing mechanism, the locking mechanism, and the forcible air discharging mechanism 5 are configured by the combination of the members disposed in the housing 10, and the respective mechanisms can be put into operation by operating the operating part 12 and the trigger part 13.

Figure 3:
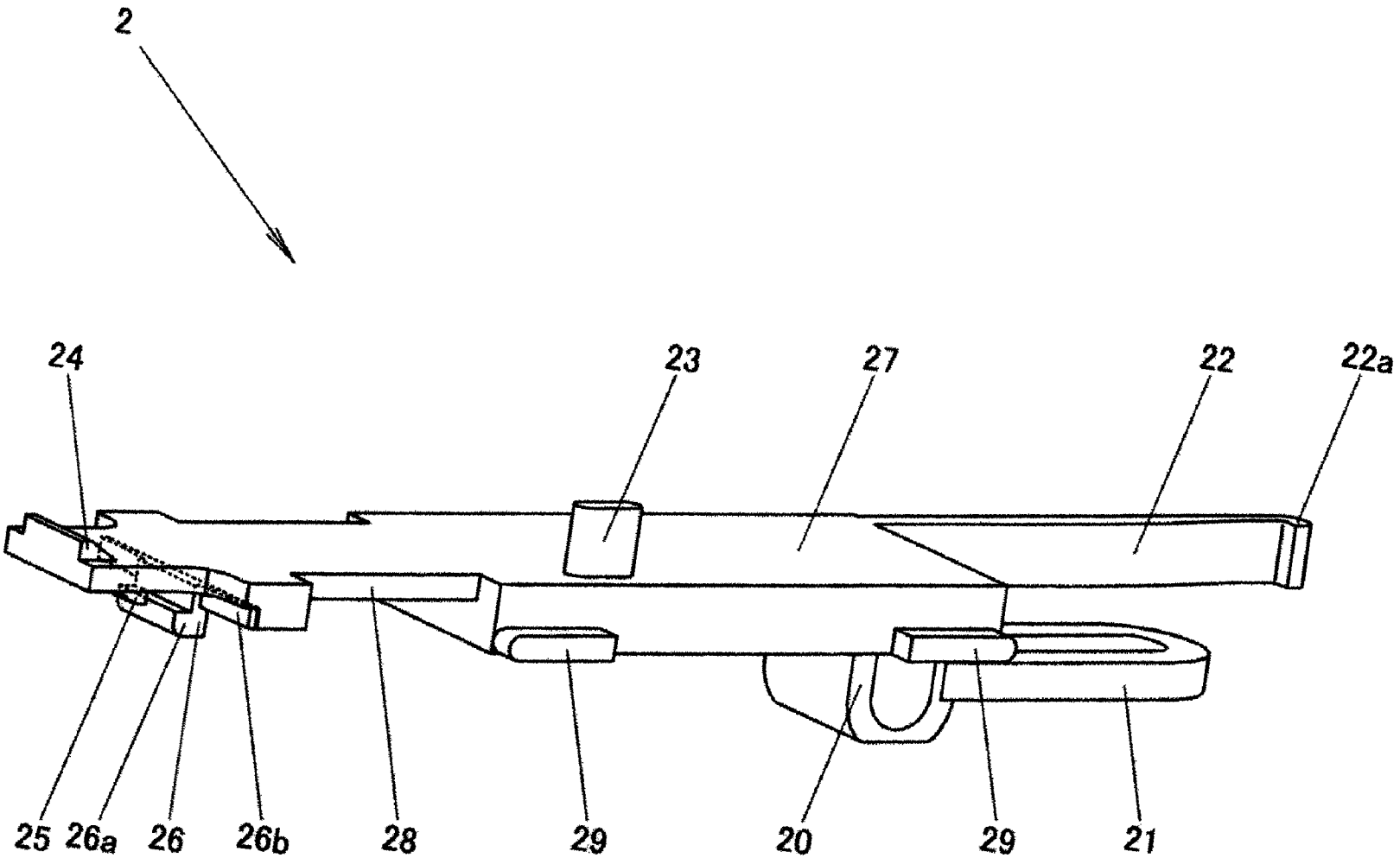
FIG. 3 is an external perspective view of a main operating member of the paper bullet firing pistol toy according to an embodiment of the invention

As is shown in FIGS. 2 and 3, the main operating member 2 has a base portion 27 which is a substantially rectangular flat plate and, by sliding pieces 29 which are substantially rectangular flat plates formed on lateral sides of the base portion 27 being fitted in groove-shaped rails formed on inner surfaces of left- and right-hand side plates of the housing 10, the main operating member 2 can be held in such a manner as to slide to move in the longitudinal direction along the rails. In addition, the main operating member 2 has the inserting attachment portion 20 which is provided on a lower side of a front portion of the base portion 27, a connecting portion 21 which projects forward from the inserting attachment portion 20, a pawl 22 which projects to the front from a front end of the base portion 27, the projection 23 which projects upwards in a predetermined position on an upper surface of the base portion and an extending portion 28 which extends to the rear from the base portion 27.

In addition, the main operating member 2 has a piston pushing portion 24 which projects upwards at a rear end of the extending portion 28, a first locking portion 25 which projects downwards in the vicinity of the rear end of the extending portion 28 and a second locking portion 26 which is disposed below the extending portion 28 at the front of the first locking portion 25.

In addition, the shaft 12*a* which is disposed in the transverse direction within the operating part 12 as has been described above is inserted and attached in place in the inserting attachment portion 20. Namely, the main operating member 2 is made to be operated together with the operating part 12 by a force being applied to the inserting attachment portion 20 by operating the operating part 12.

A hook portion 22*a* is provided at a distal end of the pawl 22, and when the main operating member 2 is moved in such a manner as to move away from the bullet forming part 3 with the hook portion 22*a* brought into engagement with a ratchet of a geared ratchet disposed in the bullet forming part 3, which will be described later, the ratchet can be made to rotate.

The projection 23 is provided in such a position that when the main operating member 2 is operated to a rear predetermined position, the projection 23 is brought into contact with a slope of an engagement claw which is formed in such a manner as to project inwards at a distal end of a locking plate 31 of the bullet forming part 3, which will be described later, to thereby elastically deform the distal end of the locking plate 31 rightwards. Namely, this projection 23 is formed so as to release a locked state resulting between the locking plate 31 of the bullet forming part 3, which will be described later, and a rear end of the cylinder 50 which is fixed to the housing 10.

The piston pushing portion 24 is, when the main operating member 2 is moved to the rear, brought into engagement with a receiving portion 58 of the piston 51, which will be described later, to thereby move the piston 51 to the rear against an elastic force of a coil spring 59, which will be described later.

The first locking portion 25 and the second locking portion 26 constitute the locking mechanism together with an engagement projecting portion 13*a* which is formed at a front upper end of the trigger part 13 in such a manner as to securely fit in a gap between the first locking portion 25 and the second locking portion 26 and act to lock the piston 51 so as to maintain a compressed state of the coil spring 59 which biases the piston 51, which will be described later.

In addition, this second locking portion 26 is held by a plate spring 26*b* which extends lengthwise in the transverse direction and a hook portion 26*a* is provided on the second locking portion 26 in such a manner as to confront the first locking portion 25. By this, a fitting space in which the engagement projecting portion 13*a* of the trigger part 13 can be fitted to be attached in place is formed between the first locking portion 25 and the hook portion 26*a* of the second locking portion 26.

Consequently, when the engagement projecting portion 13*a* of the trigger part 13 is brought into abutment with the hook portion 26*a* and the hook portion 26*a* is pressed to the front due to the main operating member 2 moving to the rear, the plate spring 26*b* is elastically deformed and the hook portion 26*a* moves slightly to the front, whereby the engagement projecting portion 13*a* is fitted and attached in place in the fitting space. In addition, a front surface of the engagement projecting portion 13*a* and a rear surface of the first locking portion 25 are formed into slopes which are made to confront each other, whereby when the main operating member 2 moves to the rear to thereby bring the first locking portion 25 and the engagement projecting portion 13*a* into engagement with each other, the trigger part 13 is rotated and the extending portion 28 of the main operating member 2 is caused to be deformed elastically so as to allow the engagement projecting portion 13*a* to easily be fitted and attached in place in the fitting space.

Figure 4:
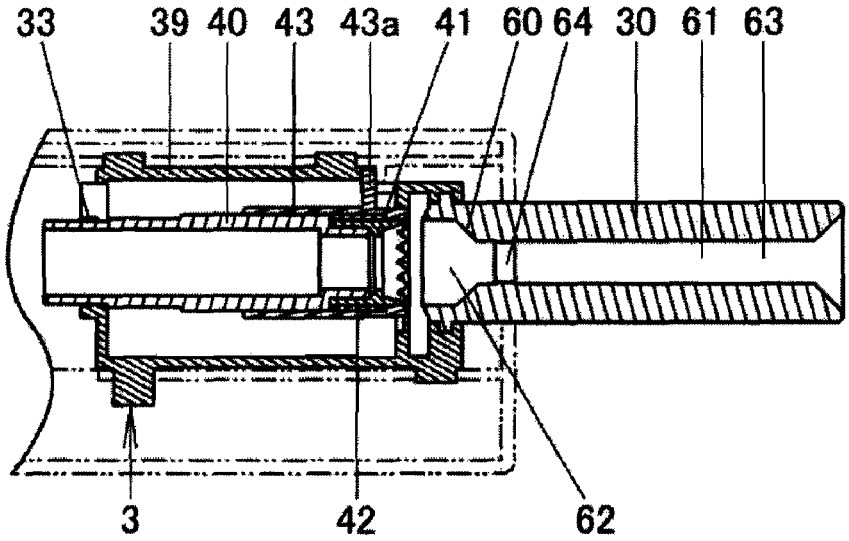
FIG. 4 shows an exemplary side view of the bullet-forming part of the paper bullet firing pistol toy according to an embodiment of the invention and a bottom view thereof with a lower portion of a case removed.
Figure 4:
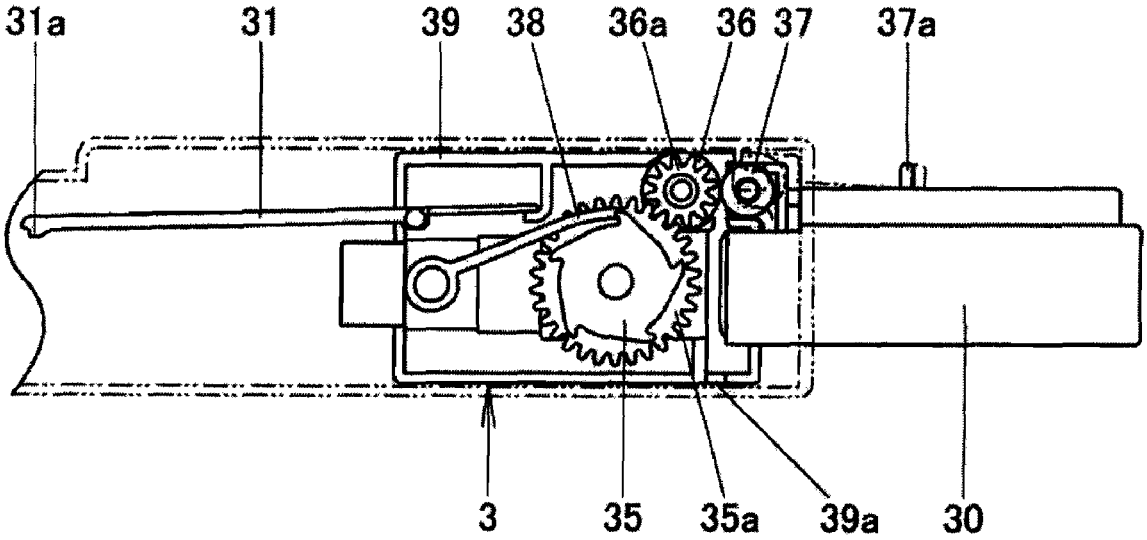

Next, referring to FIG. 4, an interior construction of the bullet forming part 3 will be described. FIG. 4(*a*) is an exemplary side view of the bullet forming part 3 according to the embodiment of the invention, and FIG. 4(*b*) is a bottom view thereof with a lower portion of a case 39 removed.

As is shown in FIG. 4, the bullet forming part 3 has the hollow rectangular parallelepiped case 39, a cutting blade 41 which is disposed within the case 39, the fixing tube 40 which fixes the cutting blade 41, a holding tube 43 which holds the cutting blade 41 and the fixing tube 40, the rollers and a gear train. In addition, the barrel part 30 is secured to a front end and the locking plate 31 is attached to a rear end of the case 39.

The cutting blade 41 has a crown shape and a number of blades are disposed circumferentially at equal intervals in such a manner as to project in an axial direction from an outer edge of a tube which configures the cutting blade 41. The fixing tube 40 is configured to hold the cutting blade 41 by being made integral with the cutting blade 41 which is fitted and attached in place to a front end thereof. The holding tube 43 is a tubular member which holds the fixing tube 40 and the cutting blade 41 on an inner circumferential surface thereof.

In addition, the holding tube 43 and the fixing tube 40 are each disposed in such a manner as to slidingly move in the longitudinal direction. Additionally, a coil spring 42, which is an elastic member, is disposed between the holding tube 43 and the fixing tube 40. This coil spring 42 is held by a projecting portion which is formed on an inner surface of a front end of the holding tube 43 in such a manner as to project inwards and a front end of a tubular portion of the fixing tube 40 which lies at an outer circumferential edge of a rear end of the cutting blade 41. Namely, the coil spring 42 is such as to bias the holding tube 43 and the fixing tube 40 in a direction in which they are spaced apart from each other.

In addition, the cutting blade 41, which is fitted and attached fixedly in place at the front end of the fixing tube 40, is disposed in such a position that the cutting blade 41 moves in the longitudinal direction so as to come into contact with and go away from the paper held on the axis center of the barrel part 30 by the rollers 36, 37. Specifically, the cutting blade 41 is pressed to a front side via the fixing tube 40 through engagement of the engagement portion 45*a* of the pressing member 45 (refer to FIG. 2) with a rear end of the fixing tube 40, when the bullet forming part 3 moves to the rear. In addition, the cutting blade 41 moves to the front relative to the paper by the movement of the bullet forming part 3 to the rear to thereby be brought into abutment with the paper to continue to move to the front further therethrough so as to cut the paper into a circular shape. Additionally, when the bullet forming part 3 moves to the front or when the engaged state between the engagement portion 45*a* and the fixing tube 40 is released, the cutting blade 41 moves to the rear relative to the paper so as to be spaced away from the paper.

The barrel part 30 has a bore portion 61 which is opened as a circular penetrating opening which configures a passage of a projectile. This bore portion 61 has a large diameter portion 62 at a rear end and a small diameter portion 63 which is formed from the vicinity of the rear end to the vicinity of a front end thereof. In addition, this bore portion 61 has a guide slope 60 which is formed in such a manner that an inside diameter in the vicinity of the rear end becomes larger than an inside diameter at the small diameter portion 63. Additionally, an auxiliary small diameter portion 64 is formed in the vicinity of a rear end of the small diameter portion 63 of the bore portion 61 in such a manner that an inside diameter thereat becomes slightly smaller. The large diameter portion 62 is formed in such a size that the rear end of the barrel part 30 is brought into abutment with the front end of the holding tube 43 and that the cutting blade 41 can be inserted thereinto.

In addition, a circular opening is formed in a rear plate of the case 39 so that the rear end of the fixing tube 40 is inserted thereinto, and a rectangular opening is formed at an upper end of the circular opening so that a front portion of the aforesaid pressing member 45 is inserted thereinto. Additionally, a projection 33 is provided on a communicating portion lying at an upper end portion of the circular opening and at a lower end portion of the rectangular opening in such a manner as to project inwards from the left and right, so as to be brought into engagement with the slope formed on the engagement portion 45*a* of the pressing member 45, whereby the front portion of the pressing member 45 can be pushed upwards.

The locking plate 31 is a substantially rectangular thin flat plate which can be deformed elastically and has at a rear end thereof an engagement claw 31*a* which is brought into engagement with a front end of the cylinder 50, which will be described later, so as to lock the bullet forming part 3 on the housing 10. This engagement claw 31*a* is formed in such a manner as to project inwards from a distal end of the locking plate 31, and a rear surface, which is brought into engagement with the cylinder 50, is formed as a flat plane which becomes perpendicular relative to the longitudinal direction of the housing 10, a front surface, which is brought into engagement with the projection 23 of the aforesaid main operating member 2, is formed as a slope.

In addition, this case 39 has a geared ratchet 35 which is made up of a ratchet and a spur gear (a first gear 36*a*), the geared roller 36 which is made up of a roller and a spur gear (a second gear 35*a*), and the roller 37 which is pivotally supported in a position which confronts the geared roller 36.

This geared ratchet 35 is disposed in such a manner as to be rotated when the ratchet is brought into engagement with the pawl 22 of the main operating member 2, whereby the main operating member 2 moves in such a manner as to be spaced relatively away relative to the bullet forming part 3. In addition, the geared roller 36 is disposed in such a manner that the second gear 36*a*, which is the spur gear of the geared roller 36, meshes with the first gear 35*a*, which is the spur gear of the geared ratchet 35. Additionally, the roller 37 is disposed to confront each other in such a manner that an axis thereof and an axis of the geared roller 36 become parallel to each other.

In addition, the pawl 22, the geared ratchet 35 and the second gear 36*a* of the geared roller 36 are configured as a roller rotating means for rotating a roller of the geared roller 36 and the roller 37 which is disposed in such a manner as to confront the geared roller 36. Namely, this roller rotating means can rotate the geared ratchet 35 by the pawl 22 which is in engagement with the ratchet of the geared ratchet 35 by causing the main operating member 2 to move in such a manner as to be spaced away relative to the bullet forming part 3 (namely, the first gear 35*a* can be caused to rotate integrally together with the ratchet) and further can rotate the geared roller 36 by rotating the second gear 36*a* which meshes with the first gear 35*a*.

Additionally, since the roller 37 is biased in such a manner as to be brought into abutment with the geared roller 36 by a coil spring which is an elastic member, not shown, the roller 37, which is in line contact with the geared roller 36, also rotates when the geared roller 36 rotates, and further, the paper can be held between the geared roller 36 and the roller 37.

In addition, this roller 37 is provided in such a manner as to be connected to an operating projection 37*a* which is formed in front of the roller 37 so as to move in the longitudinal direction, and by operating the operating projection 37*a*, the roller 37 is made to freely come into contact with and go away from the geared roller 36. In addition, by operating the operating projection 37*a*, the roller 37 is formed so as to hold the state in which the roller 37 is spaced away from the roller 36.

In addition, in this embodiment, although since the roller 37, the coil spring which biases the roller 37 and the operating projection 37*a* are configured in such a manner that by pushing the operating projection 37*a* inwards and to the front, the roller 37 is caused to move outwards so that rear ends of an upper plate and a lower plate which are bearing surfaces of the roller 37 are made to be brought into engagement with a projecting piece on the right-hand housing and that the bullet forming part 3 is fixed to the housing 10 so as not to move when the roller 37 is brought into engagement with the projection piece on the housing 10 so as to be spaced away from the geared roller 36, the paper can easily be inserted between the rollers, the invention is not limited to this configuration, and hence, various roller 37 biasing means and various means for bringing the roller 37 into contact with and separation from the geared roller 36 can be adopted.

Namely, this paper bullet firing pistol toy 1 is configured in such a manner that when the respective mechanisms are in their initial states, the roller 37 is spaced apart from the geared roller 36 by operating the operating projection 37*a*, and after the strip of paper is inserted from an insertion port 39*a* which is a rectangular opening formed in a lateral side of the case 39, the roller 37 is brought into abutment with the geared roller 36 via the strip of paper by operating the operating projection 37*a*, whereby the paper can easily be mounted in the paper bullet firing pistol toy 1.

In addition, since a reverse rotation preventive plate 38, which can be deformed elastically, is attached to the ratchet of the geared ratchet 35, the paper is made to be prevented from being fed in a reverse direction by the geared ratchet 35 which rotates reversely when the main operating member 2 is moved to the front so as to be restored with the pawl 22 brought into engagement with the ratchet.

Figure 5:
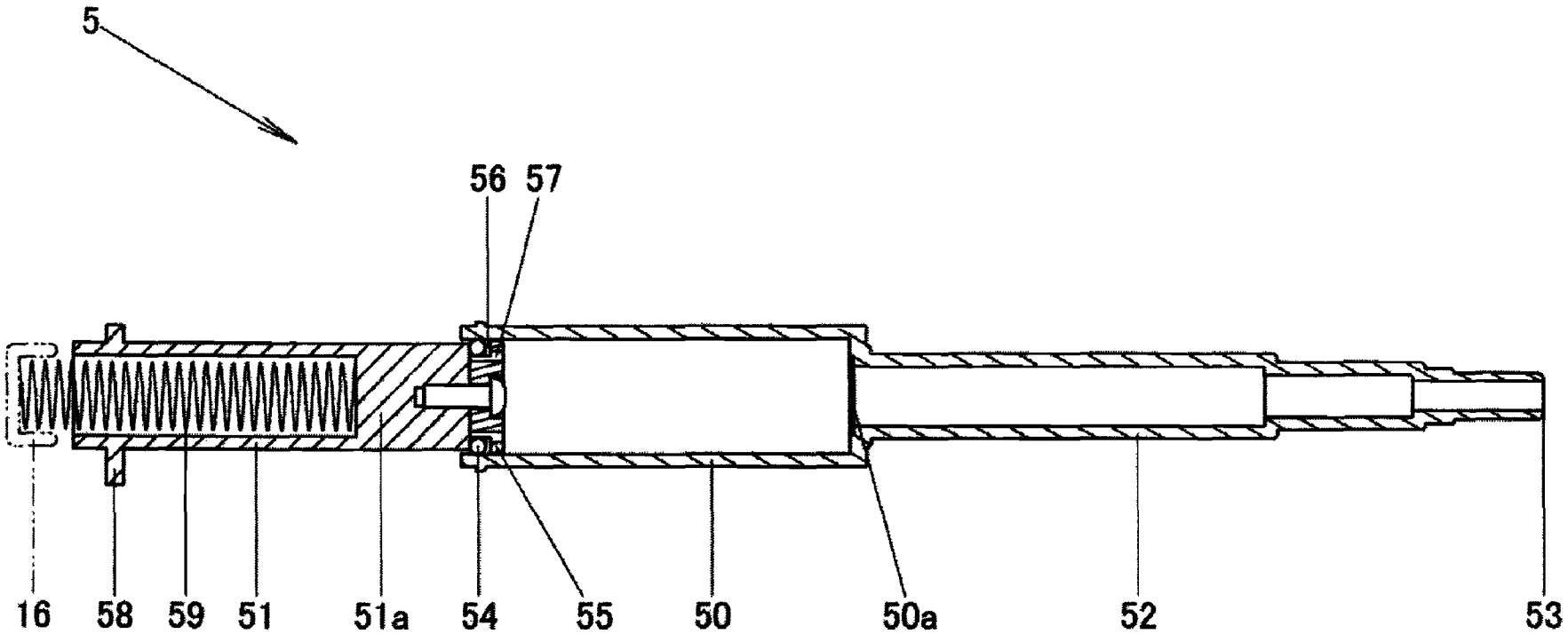
FIG. 5 is an exemplary side view of the forcible air discharging mechanism of the paper bullet firing pistol toy according to an embodiment of the invention.

Next, referring to FIGS. 2 and 5, the forcible air discharging mechanism 5 will be described. FIG. 5 is an exemplary side view of the forcible air discharging mechanism 5 according to the embodiment of the invention. The forcible air discharging mechanism 5 has the circular cylindrical cylinder 50, the circular cylindrical piston 51 which includes one closed end as a piston head portion 51*a* and the coils spring 59 which is the elastic member.

The cylinder 50 is fixed to the housing 10 in such a manner that its center axis becomes coaxial with a center axis of the barrel part 30. In addition, a discharge port 50*a*, which is a circular opening which adopts the axis center of the barrel part 30 as its center axis, is opened in a front end portion of the cylinder 50. Additionally, an airway tube 52 is provided at the front of the cylinder in such a manner as to be connected thereto and to communicate with the discharge port 50*a* for sending air displaced by the piston 51 inserted into the cylinder 50 to the bore portion 61 from the discharge port 50*a*.

This airway tube 52 is a circular cylindrical tube which extends to the front of the cylinder 50, and a distal end portion thereof is formed as a paper push-out portion 53 which is formed in such a size that it can be fitted in the small diameter portion 63 of the bore portion 61. In addition, the piston 51 is disposed in such a manner as to slide in the longitudinal direction within the cylinder 50. Additionally, a disk-shaped ring mounting plate 55 is attached to the piston head portion 51*a* of the piston 51 by threads. Through holes 57 are opened at equal intervals in a circumferential direction in the ring mounting plate 55.

In addition, this ring mounting plate 55 is formed in such a manner that an outside diameter at a rear portion becomes smaller than one at a front portion thereof. Namely, in this ring mounting plate 55, the rear portion is formed in such a manner as to extend a predetermined distance to the rear of the front portion of the ring mounting plate 55 so that a ring groove 56 of a predetermined width is defined when the ring mounting plate 55 is attached to the piston head portion 51*a* by threads.

In addition, an O ring 54 is mounted in the ring groove 56 between the front portion of the ring mounting plate 55 and the piston head portion 51*a* in such a manner as to slide in the longitudinal direction. By the O ring 54 being disposed in the ring groove 56 in this way, when the O ring 54 moves to the rear to thereby be closely attached to the piston head portion 51*a*, a space between the cylinder 50 and the piston 51 is sealed by the O ring 54. In addition, since the through holes 57 are opened in such a manner as to communicate with the ring groove 56, when the O ring 54 moves to the front to thereby be closely attached to the front portion of the ring mounting plate 55, a space between an outer circumferential surface of the piston 51 and an inner circumferential surface of the cylinder 50 and the through holes 57 in the ring mounting plate 55 are made to communicate with each other, whereby air is allowed to flow into the space between the cylinder 50 and the piston 51.

In addition, the coil spring 59 is disposed in such a manner that one end is brought into contact with the support plate 16 of the housing 10 and the other end thereof is brought into contact with a rear end of the piston head portion 51*a* of the piston 51. Namely, the coil spring 59 biases the piston 51 to the front so that the coil spring 59 is compressed in the longitudinal direction by moving the main operating member 2 to the rear in such a state that the aforesaid piston pushing portion 24 is in engagement with the receiving portion 58 that is formed in the vicinity of a lower rear end of the piston 51 and pushes the piston 51 to the front when released from the compressed state.

Figure 6:
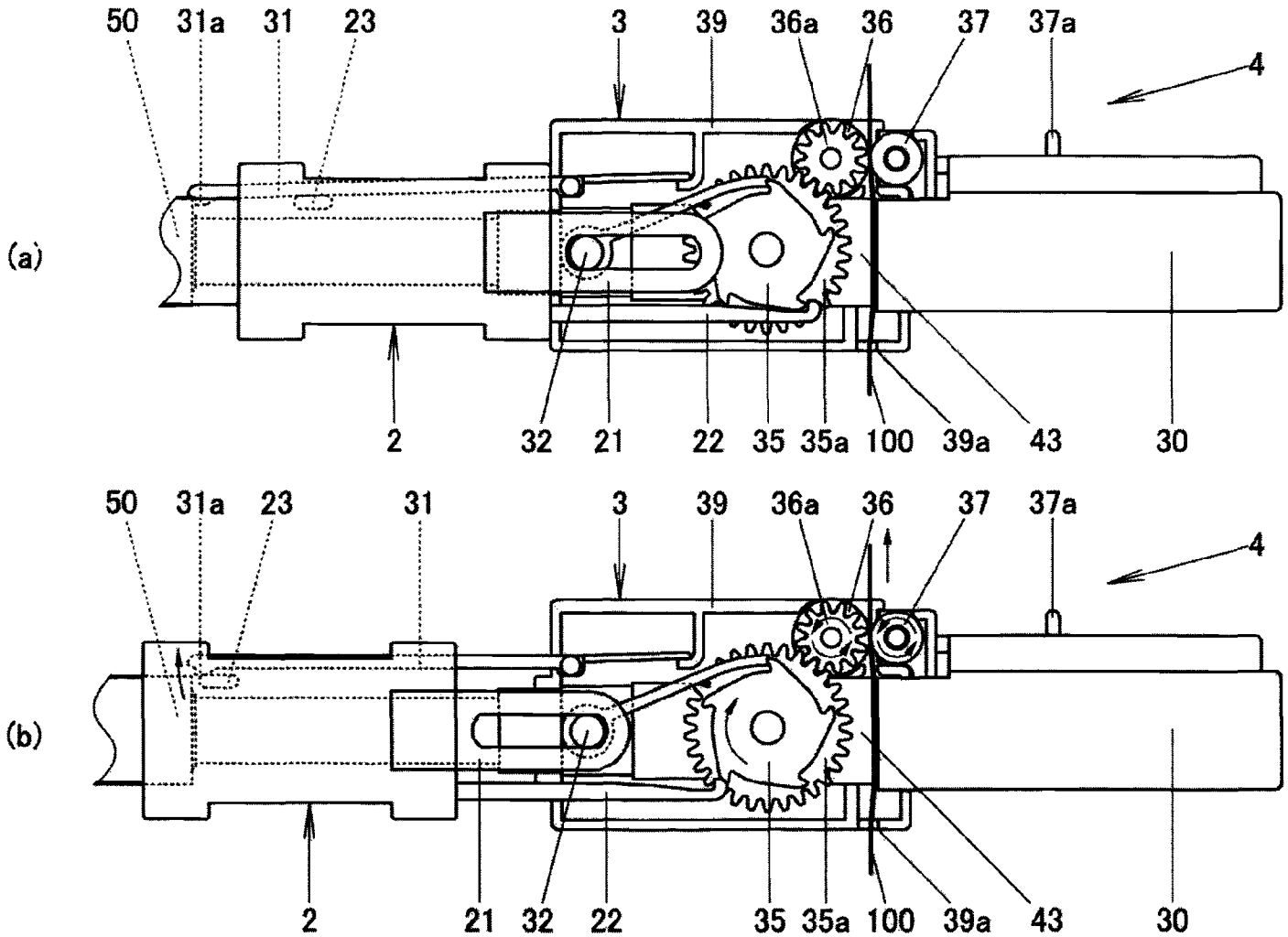
FIG. 6 is an exemplary bottom view showing the operation of the paper feeding mechanism of the paper bullet firing pistol toy according to an embodiment of the invention.

Hereinafter, referring to FIGS. 6 to 9, the configurations and operations of the paper feeding mechanism 4, the paper cutting mechanism 7, the paper drawing mechanism 6, the forcible air discharging mechanism 5 and the locking mechanism 8 will be described. As is shown in FIG. 6, the paper feeding mechanism 4 includes the pawl 22 of the main operating member 2, the geared ratchet 35 which is brought into engagement with the pawl 22, the geared roller 36 having the second gear 36*a* which meshes with the first gear 35*a* of the geared ratchet 35 and the roller 37 which holds the paper 100 together with the geared roller 36.

In addition, the paper feeding mechanism 4 includes further as its constituent elements the locking plate 31 which fixes the bullet forming part 3 in such a manner that the bullet forming part 3 is prevented from being moved to the rear together with the main operating member 2 when the operating part 12 which is being in its initial position is operated to move to the rear and the projection 23 which releases the fixed state of the bullet forming part 3 when a paper feeding operation is completed.

As has been described before, this locking plate 31 has the engagement claw 31*a* which is formed at the distal end in such a manner as to project inwards. In addition, as is shown in FIG. 6(*a*), this paper feeding mechanism 4 is disposed in such a manner that the engagement claw 31*a* of the locking plate 31 attached to the rear end of the bullet forming part 3 is brought into engagement with the front end of the cylinder 50 fixed to the housing 10 when the operating part 12 is disposed in its initial position. Consequently, when the main operating member 2 moves to the rear together with the operating part 12, as is shown in FIG. 6(*b*), since the connecting post 32 is loosely inserted in a sliding groove of the connecting portion 21 of the main operating member 2 in such a manner as to slide therein, the bullet forming part 3 is fixed without being allowed to move together with the main operating member 2.

Namely, by the engagement claw 31*a* being brought into engagement with the cylinder 50, when the main operating member 2 moves to the rear, the bullet forming part 3 is fixed to the housing 10 and the geared ratchet 35 which is in engagement with the pawl 22 is allowed to rotate. In addition, when the geared ratchet 35 rotates, since the first gear 35*a* and the second gear 36*a* are in a meshing state, the geared roller 36 rotates. Further, when the geared roller 36 rotates, since the roller 37 which is in line contact therewith via the paper 100 rotates, the paper 100 which is held by the geared roller 36 and the roller 37 is made to move in a lateral direction which becomes perpendicular relative to the axis center of the barrel part 30. Namely, by causing the paper feeding mechanism 4 to operate, fresh paper, which will be described later, for producing projectiles and which has not been cut can be disposed on the axis center of the barrel part 30 at all times.

In addition, the paper 100 has a strip shape which has a width of the order of 20 mm and an arbitrary length and is held in advance between the geared roller 36 and the roller 37. Here, as has been described before, the coil spring which is the elastic member, not shown, is disposed at the front of the roller 37 so as to press the roller 37 to the rear, whereby the geared roller 36 and the roller 37 are allowed to hold the paper 100 therebetween. In addition, since the paper 100 is also held by the distal end of the holding tube 43 and the rear end of the barrel part 30, the paper 100 is made to easily be cut by the cutting blade 41 of the paper cutting mechanism 7, which will be described later.

Here, although the holding tube 43 holds the paper 100 together with the barrel part 30 by being pressed against by the aforesaid coil spring 42 provided between the holding tube 43 and the fixing tube 40, when the paper feeding mechanism 4 is activated from its initial state to feed the paper as is shown in FIG. 4 (namely, in such a state that the bullet forming part 3 is fixed in its initial position), an engagement plate 43*a*, which is provided on an outer circumferential surface of the holding tube 43 in such a manner as to be suspended therefrom to project outwards, is brought into engagement with a receiving plate of the housing 10 and holds a state in which the holding tube 43 is moved to the rear against the elastic force of the coil spring 42 which biases the holding tube 43 to the front.

Namely, when the paper 100 is fed by the paper feeding mechanism 4, a space is defined between the holding tube 43 and the barrel part 30, and by the rollers 36, 37 being caused to rotate by the roller rotating means, the paper 100 which is held by the rollers 36, 37 can easily be fed in the lateral direction.

In addition, as is shown in FIG. 6(*b*), when the paper 100 is fed as a result of the geared ratchet 35 rotating one fifth of its one full rotation, the projection 23 of the main operating member 2 is brought into engagement with a slope formed at the front of the engagement claw 31*a* at the distal end of the locking plate 31 of the bullet forming part 3 to thereby push the distal end of the locking plate 31 outwards. Consequently, the locking plate 31 is deformed elastically in such a manner that the distal end thereof moves outwards, whereby the engaged state between the engagement claw 31*a* and the cylinder 50 is released.

In addition, although this locking plate 31 is configured in such a manner that when in its initial state, the engagement claw 31*a* is situated downwards so as to be brought into engagement with the cylinder 50 by a member having a J-shaped cross section which projects inwards from a lateral plate of the case 39 and can be deformed elastically when the projection 23 is brought into engagement with the slope on the engagement claw 31*a*, the locking plate 31 may be formed integrally with the case 39 rather than being formed as a separate member to be attached to the case 39.

In addition, as this occurs, since in the main operating member 2 and the bullet forming part 3, the front end of the sliding groove of the connecting portion 21 and the connecting post 32 of the bullet forming part 3 are brought into engagement with each other, when the main operating member 2 moves to the rear from this state, the bullet forming part 3 also comes to operate together with the main operating member 2. Namely, the bullet forming part 3 is configured in such a manner that it is being fixed while the paper 100 is being fed by the paper feeding mechanism 4 being put into operation as a result of the movement of the main operating member 2, and after the paper feeding operation by the paper feeding mechanism 4 is completed, the bullet forming part 3 is connected to the main operating member 2 so that can move together with the main operating member 2.

In addition, while the paper 100 disposed at the axis center of the barrel part 30 is cut by the paper cutting mechanism 7 and is formed as a projectile by the paper drawing mechanism 6, by the paper feeding mechanism 4 being configured in the way described above, fresh paper 100 can be disposed at the axis center of the barrel part 30 as an initial operation for each shooting.

Figure 7:
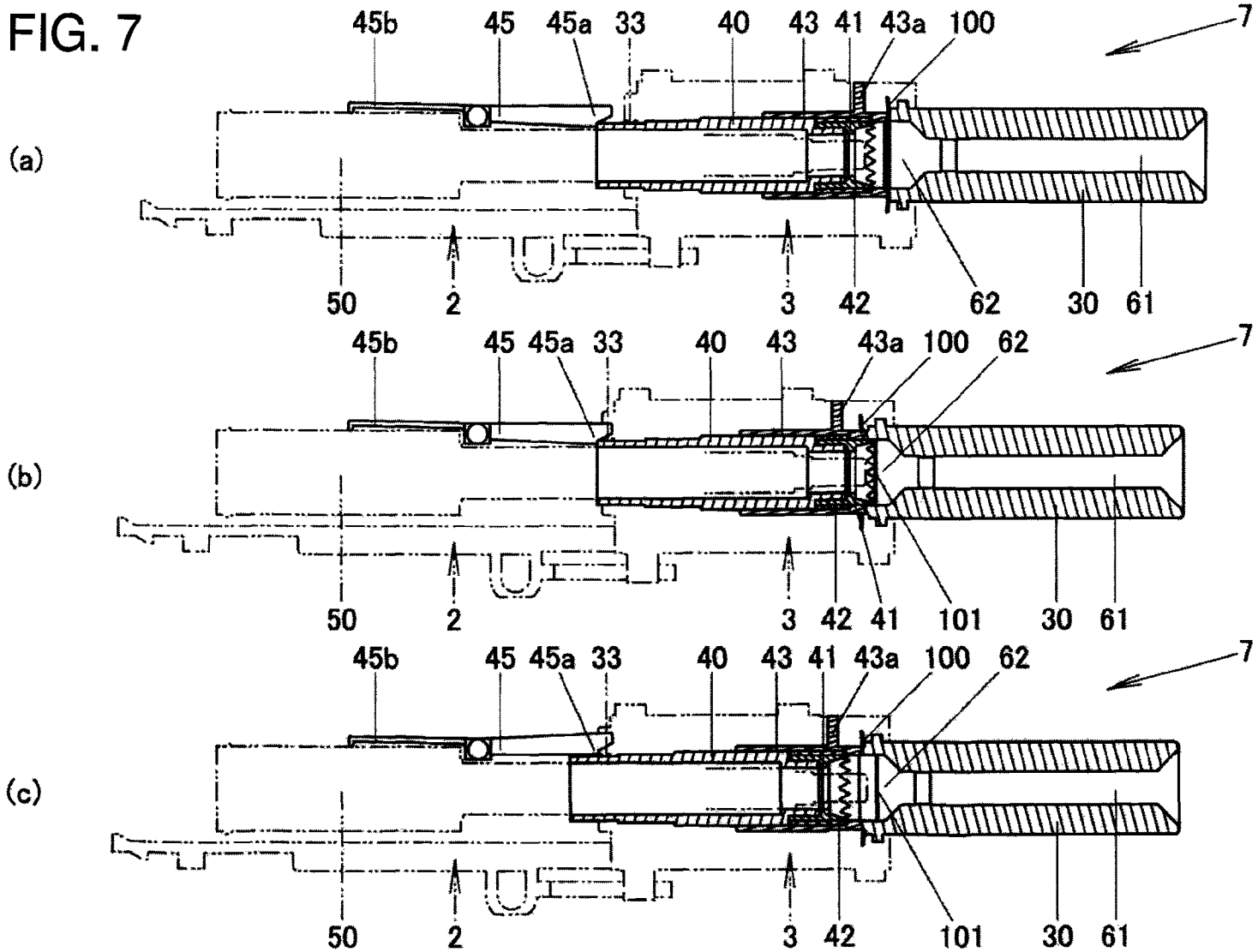
FIG. 7 is an exemplary side view showing the operation of the paper cutting mechanism of the paper bullet firing pistol toy according to an embodiment of the invention.

In addition, as is shown in FIG. 7, the paper cutting mechanism 7 includes the cutting blade 41, the fixing tube 40 which fixes the cutting blade 41 to the distal end thereof, the holding tube 43 which holds the fixing tube 40 and the cutting blade 41 in such a manner as to slide in the longitudinal direction in the predetermined position, the coil spring 42 which presses the holding tube 43 to the front so as to bring it into contact with the barrel part 30 and restores the cutting blade 41 to its initial position, the pressing member 45 which presses against the fixing tube 40 so as to force the cutting blade 41 into the paper 100 to cut it through, and the barrel part 30 having the bore portion 61 which holds paper 101 so cut. By this, the paper cutting mechanism 7 can cut the paper 100 which is held between the holding tube 43 which is biased to the front so as to be closely attached to the rear end of the barrel part 30 and the rear end of the barrel part 30 and on the axis center of the barrel part 30 by the cutting blade 41.

When, after the paper 100 has been fed by the paper feeding mechanism 4, the main operating member 2 and the bullet forming part 3 are disposed in the predetermined positions by the operating part 12 being caused to move to the rear further, as is shown in FIG. 7(*a*), in the paper cutting mechanism 7, the engagement portion 45*a* which is formed at the rear end of the pressing member 45 comes into contact with the rear end of the fixing tube 40. In addition, as this occurs, since the engaged state between the engagement plate 43*a* and the receiving plate of the housing 10 has been released, the holding tube 43 and the barrel part 30 hold the paper 100 therebetween by the holding tube 43 being biased to the front so as to be brought into abutment with the rear end of the barrel part 30 by the coil spring 42.

In addition, as is shown in FIG. 7(*b*), when the main operating member 2 and the bullet forming part 3 are caused to move to the rear together by the operating part 12 being caused to move to the rear further, the fixing tube 40 is fixed by the engagement portion 45*a* of the pressing member 45, whereby the blades of the cutting blade 41 are forced into the paper 100 to cut it through, so that the paper 100 is cut to form a cut circular piece of paper 101.

Then, when the cutting blade 41 is forced into the large diameter portion 62 of the bore portion 61 to complete the cutting operation, the slope formed on the front surface of the engagement portion 45*a* of the pressing member 45 is pressed against by the projection 33 which is formed at the rear end of the case 39, whereby, as is shown in FIG. 7(*c*), the plate spring 45*b* is deformed elastically in such a manner that the front end of the pressing member 45 moves upwards. By this, the engaged state between the flat plane downwards of the slope on the engagement portion 45*a* and the rear end of the fixing tube 40 is released, whereby the fixing tube 40 is pushed out to the rear by the coil spring 42, so that the bullet forming part 3 is allowed to move to the rear further together with the main operating member 2.

In addition, as has been described before, in this pressing member 45, since the engagement portion 45*a* is situated downwards by the plate spring 45*b* having the L-shaped cross section which configures the rear portion of the pressing member 45 being brought into engagement with an upper portion of the outer circumferential surface of the cylinder 50, when the bullet forming part 3 moves to the rear, the engagement portion 45*a* is made to be brought into engagement with the rear end of the fixing tube 40. In addition, although the plate spring 45*b* is made to be deformed elastically when the projection 33 is brought into engagement with the slope of the engagement portion 45*a*, the invention is not limited to the case where the pressing member 45 is formed as the separate member which is attached to the housing 10, and hence, the pressing member 45 may be formed integrally with the housing 10 and the cylinder 50 or the whole of the pressing member 45 may be made to be deformed elastically.

Figure 8:
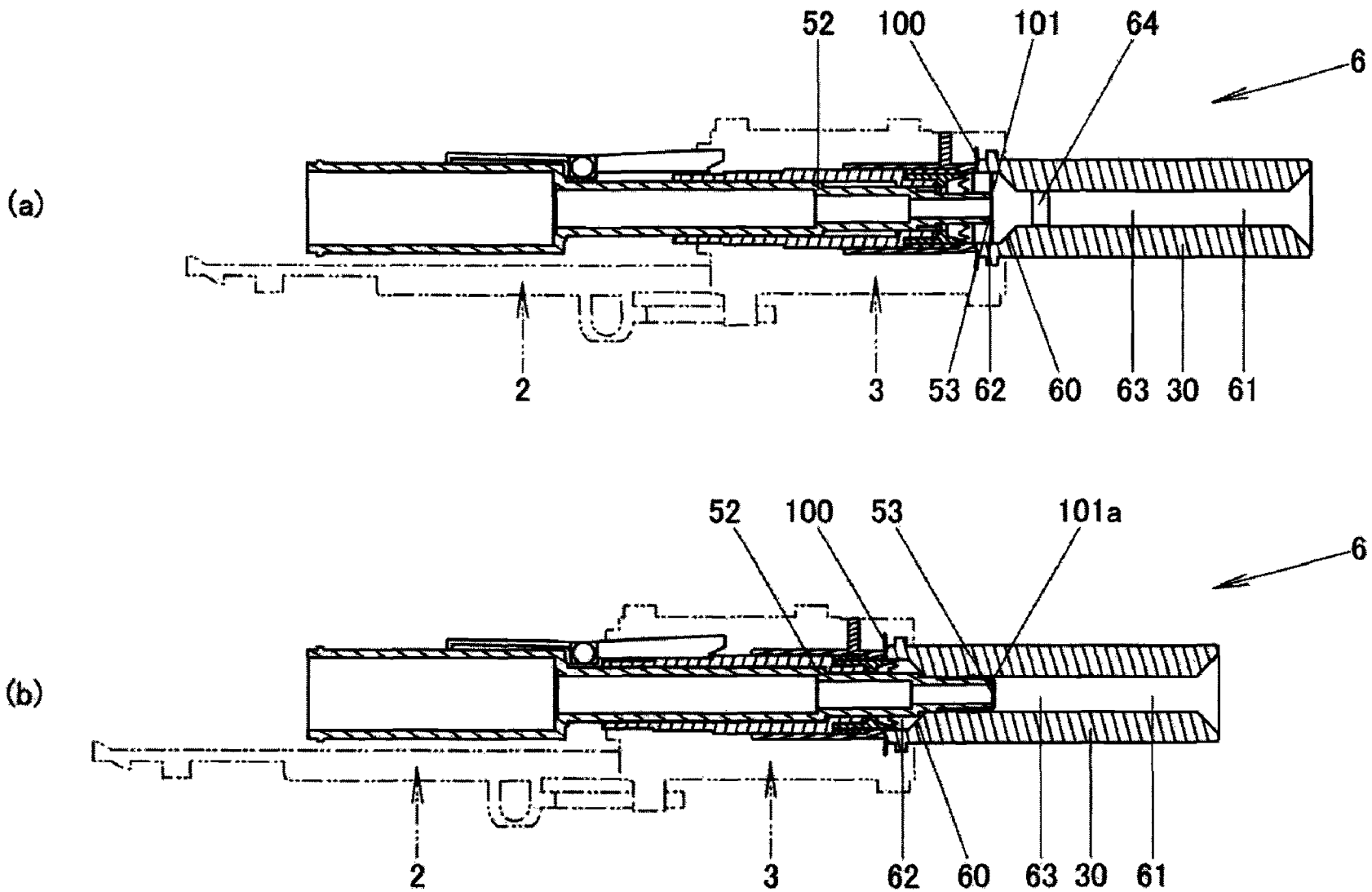
FIG. 8 is an exemplary side view showing the operation of the paper drawing mechanism of the paper bullet firing pistol toy according to an embodiment of the invention.

In addition, when the paper 100 is cut to form the cut circular piece of paper 101 by the paper cutting mechanism 7, a circumferential portion of the cut paper 101 is bent inwards by the paper drawing mechanism 6 as is shown in FIG. 8 to thereby produce a projectile 101*a*. Specifically, this paper drawing mechanism 6 includes the paper pushing portion 53 which configures the distal end portion of the airway tube 52 which is the circular cylindrical tube extending to the front from the cylinder 50 and the bore portion 61 of the barrel part 30 into which the paper pushing portion 53 is fitted. In addition, as is shown in FIG. 8(*a*), when the bullet forming part 3 moved to the rear together with the main operating member 2 by the operating part 12 being operated to move to the rear further after the paper 100 has been cut, the paper pushing portion 53, which configures the front end of the airway tube 52, comes into abutment with the cut paper 101.

Then, as is shown in FIG. 8(*b*), when the bullet forming part 3 moves to the rear further, the cut paper 101 is fixed in position by the paper pushing portion 53, and the outer circumferential portion thereof is bent inwards gradually by the guide slope 60 on the bore portion 61 and is then forced into the small diameter portion 63. Here, since the auxiliary small diameter portion 64 whose diameter is smaller than that of the small diameter portion 63 is formed in the vicinity of the rear end of the small diameter portion 63, the outer circumferential portion of the cut paper 101 is bent inwards further to be formed into the projectile 101*a* when the cut paper 101 passes through the auxiliary small diameter portion 64.

In addition, the projectile 101*a* which has passed through the auxiliary small diameter portion 64 is slightly expanded outwards at its outer circumferential portion. However, since the projectile 101*a* is formed into a shape having a substantially U-shape cross section and is held in a closely attached state in which its outer circumferential portion is held by the paper pushing portion 53 and the small diameter portion 63, the projectile 101*a* is made to receive air discharged by the forcible air discharging mechanism 5, which will be described later, with good efficiency.

In addition, the piston 51 is pushed to the rear by the piston pushing portion 24 formed at the rear end of the main operating member 2 pressing the receiving portion 58 of the piston 51 when the operating part 12 is caused to move to the rear. Additionally, as is shown in FIG. 9(*a*), when the operating part 12 moves to the rear end, the coil spring 59 disposed at the rear end of the piston 51 is compressed, and this compressed state is maintained by the locking mechanism 8.

This locking mechanism 8 includes the first locking portion 25 and the second locking portion 26 which are formed in the vicinity of the rear end of the main operating member 2 and the engagement projecting portion 13*a* of the trigger part 13. In addition, by the engagement projecting portion 13*a* of the trigger part 13 being fitted and attached in place in the fitting space defined between the first locking portion 25 and the second locking portion 26, the engagement projecting portion 13*a* locks the first locking portion 25 and the piston pushing portion 24 locks the piston 51 against the elastic force of the coil spring 59.

Figure 9:
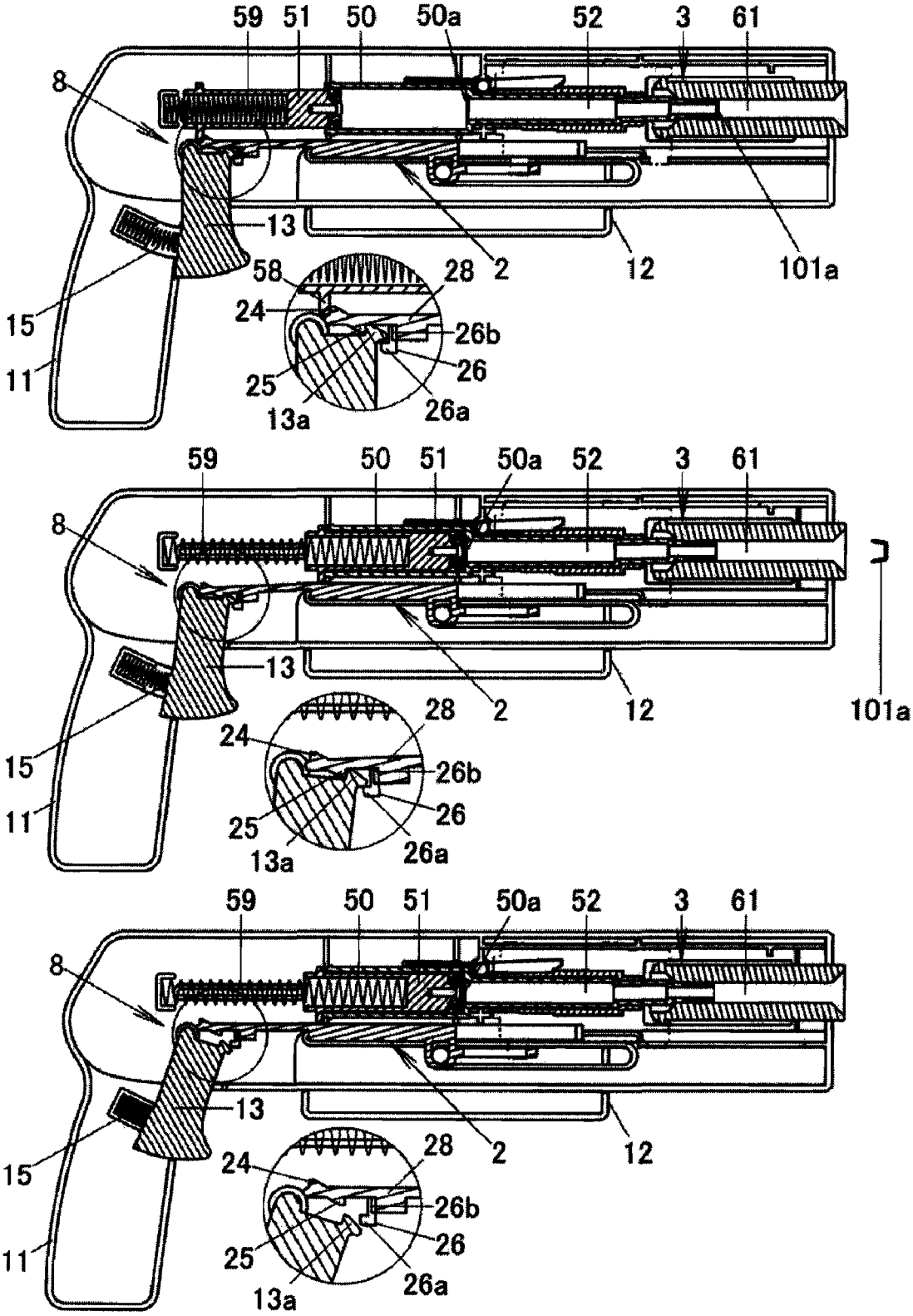
FIG. 9 is an exemplary side view showing the operation of the forcible air discharging mechanism and the lock releasing operation of the paper bullet firing pistol toy according to an embodiment of the invention.

In addition, in the event that the user rotates the trigger part 13 in such a way as to perform a trigger pulling operation when this locked state exists, as is shown in FIG. 9(*b*), the engagement projecting portion 13*a* presses down the hook portion 26*a* of the second locking portion 26. By this action, the extending portion 28 is deflected and the rear end of the main operating member 2 moves downwards, whereby the engaged state between the piston pushing portion 24 and the receiving portion 58 is released, and the piston 51 is pushed to the front by virtue of the elastic force of the coil spring 59.

Then, when the piston 51 is forcibly inserted into the cylinder 50 by virtue of the elastic force of the coil spring 59 by the locked state of the piston 51 being released, air residing within the cylinder 50 is compressed to be jetted from the discharging port 50*a* and flows into the bore portion 61 via the airway tube 52 to apply a pressure to the projectile 101*a* which is held in the bore portion 61. Consequently, the projectile 101*a* is pushed out by a stream of compressed air which has been jetted from the cylinder 50 and is then shot from the muzzle.

Then, when the trigger part 13 is caused to rotate further, since the engagement projecting portion 13*a* presses against the hook portion 26*a* in such a manner as to deform the plate spring 26*b* elastically, the second locking portion 26 is spaced apart from the first locking portion 25 slightly, and as is shown in FIG. 9(*c*), the engagement projecting portion 13*a* which is fitted and attached in place in the fitting space which defined between the first locking portion 25 and the second locking portion 26 is dislocated therefrom.

Since the locked state between the main operating member 2 and the bullet forming part 3 and the operating part 12 is released by this action, in the event that the operating part 12 is caused to move to the front again, the respective mechanisms 4 to 8 of the paper bullet firing pistol toy 1 can be restored to their initial states. In addition, also as to the trigger part 13, since a lower portion of the trigger part 13 is pushed to the front by virtue of the elastic force of a coil spring 15, which is an elastic member attached to a support plate which has a U-shaped cross section and which is provided at an upper portion in the grip part 11 and a rear end of the lower portion of the trigger part 13, the trigger part 13 can be restored.

In this way, by the paper feeding mechanism 4, the paper cutting mechanism 7, the paper drawing mechanism 6 and the forcible air discharging mechanism 5 being provided, the paper bullet firing pistol toy 1 can be provided in which the projectile 101 is produced and is held in the bore portion 61 by executing the shooting preparing operation in which the paper feeding mechanism 4, the paper cutting mechanism 7, the paper drawing mechanism 6 and the forcible air discharging mechanism 5 perform the series of operations by operating the operating part 12, the projectile 101*a* is shot from the muzzle by releasing the locked state of the forcible air discharging mechanism 5 by the locking mechanism 8 by operating the trigger part 13 so that air residing within the cylinder 50 is compressed to be jetted by the piston 51 and is then jetted against the projectile 101*a* within the bore portion 61, and projectiles 101*a* can be shot sequentially by restoring the respective mechanisms 4 to 8 in their initial states by restoring the operating part 12 to its initial position.

In addition, in this paper bullet firing pistol toy 1, since the paper 100 can be formed into the projectile 101*a*, no ready-made projectiles need to be prepared in advance, and a shooting play can be enjoyed by the use of paper available around the user. Additionally, even in case the projectile 101*a* so shot strikes a child who plays with the user or the like, there is no case where he or she gets injured, and therefore, they can play safe with the pistol toy. Further, there is no concern about disposal of projectiles 101*a*.

In addition, in this paper bullet firing pistol toy 1, since the locking mechanism 8 is configured in such a manner as to execute the releasing operation of the locked state of the forcible air discharging mechanism 5 and the releasing operation of the locked state of the operating part 12 at different timings, the operating part 12, the main operating member 2 and the bullet forming part 3 are prevented from moving at the same time as the forcible air discharging mechanism 5 operates due to the projectile 101*a* being shot downwards or the trigger part 13 being rotated to activate a lock releasing operation with both the locked states being released at the same time or the operating part 12 being not locked, thereby making it possible to jet a stream of air against the projectile 101*a* with good efficiency.

In addition, since the through holes 57 are opened in the ring mounting plate 55 which is secured to the front end of the piston 51 in such a manner as to communicate with the ring groove 56, when the piston 51 is caused to move to the rear, the O ring 54 moves relatively to the front relative to the piston 51 to thereby be closely attached to the front portion of the ring mounting plate 55 due to friction with the inner circumferential surface of the cylinder 50, whereby a communication is established between the cylinder 50 and the piston 51 by the through holes 57. By this, even in such a state that the projectile 101*a* is closely attached to a distal end portion of the airway tube 52, since air is allowed to flow into the cylinder 50 from the rear of the cylinder 50, the piston 51 can easily be caused to move to the rear.

In addition, when the piston 51 is pushed out to the front by the coil spring 59 by releasing the locked state of the forcible air discharging mechanism 5, since the O ring 54 moves relatively to the rear relative to the piston 51 to thereby be closely attached to the front end of the piston head portion 51*a* of the piston 51 due to friction with the inner circumferential surface of the cylinder 50, the space between the cylinder 50 and the piston 51 is sealed, thereby making it possible to jet air against the projectile 101*a* with good efficiency.

In addition, the invention is not limited to the embodiment that has been described heretofore but can freely be modified or improved without departing from the spirit and scope of the invention. For example, the invention is not limited to the case where the barrel part 30 is secured to the bullet forming part 3, and hence, a configuration may be adopted in which the barrel part 3 is secured detachably to the bullet forming part 3. By this configuration, the bore portion 61 and the airway tube 52 can easily be serviced for maintenance.

Additionally, while the guide slope 60 and the auxiliary small diameter portion 64 are provided on the bore portion 61 for the purpose of easy and ensured formation of the projectile 101*a*, the large diameter portion 62 and the small diameter portion 63 may be provided in such a manner as to be connected to each other on a plane which is at right angles to the axis center of the barrel part 30 without forming the guide slope 60, or the auxiliary small diameter portion 64 can be omitted. Further, the cut-out shape of the projectile 101*a* as the paper bullet is not limited to the circular shape, and hence, an oval shape may be adopted, or a polygonal shape such as a hexagonal shape, an octagonal shape and the like may be adopted.

In addition, this paper bullet firing pistol toy 1 can include further a container which accommodates paper and a roll of tape into which a strip of long paper 100 is rolled in a compact fashion can be contained in the container, thereby making it possible to shoot projectiles 101*a* continuously. This container has, for example, a hollow circular cylindrical shape and has cuts formed on a circumferential surface thereof in such a manner as to correspond to the width of the paper. In addition, with the container secured to a lateral plate of the case 39 and one end portion of the paper held between the rollers 36, 37 in such a state that the paper is accommodated in the container, the paper is made to be fed to the rollers 36, 37 from the container every time shooting is implemented.

In use, the paper bullet firing pistol toy shooting preparing operation is implemented by operating the operating part, thereafter, the paper bullet is shot from the muzzle by operating the trigger part, and the respective mechanisms can be restored to their initial states by restoring the operating part to its initial position, thereby making it possible to shoot paper bullets continuously.

What is claimed is:

1. A paper bullet firing pistol toy comprising:

a housing having a grip part;

a barrel part fixed to a front end of the housing;

an operating part which is disposed at a front lower portion of the housing in such a manner as to move in a longitudinal direction relative to the housing;

a trigger part which is connected rotatably to the vicinity of the grip part;

a paper feeding mechanism which has rollers which are disposed in the vicinity of a front end of the housing for holding a strip of paper on an axis center of the barrel part and a roller rotating means for rotating the rollers;

a paper cutting mechanism which has a crown-shaped cutting blade disposed in such a manner as to move in the longitudinal direction relative to the paper held on the axis center of the barrel part by the rollers so as to come into contact with and go away from the paper and a pressing member for pressing the cutting blade;

a forcible air discharging mechanism which has a circular cylindrical cylinder fixed on the axis center of the barrel part, a piston disposed in such a manner as to move in the longitudinal direction within the cylinder and an elastic member for biasing the piston to the front;

a paper drawing mechanism which has a distal end portion of a circular cylindrical tube which extends towards the front from the cylinder and a bore portion of the barrel part into which the distal end portion is fitted; and a locking mechanism for locking the piston against an elastic force of the elastic member, wherein the paper is moved in a direction which is perpendicular relative to the axis center of the barrel part by the paper feeding mechanism by moving the operating part to the rear so that the paper is disposed on the axis center of the barrel part, the paper disposed on the axis center of the barrel part is cut by the paper cutting mechanism, a projectile is produced by bending inwards an outer circumferential portion of the paper so cut by the paper drawing mechanism, and the piston of the forcible air discharging mechanism is locked by the locking mechanism against the elastic force of the elastic member, wherein the locked state of the piston is released by rotating the trigger part so that the piston is caused to be inserted into the cylinder by virtue of the elastic force of the elastic member so as to spray air residing within the cylinder against the projectile to thereby shoot the projectile to the front from a distal end of the barrel part, and wherein the respective mechanisms are restored by moving the operating part to the front.

2. A paper bullet firing pistol toy as set forth in claim 1, wherein the locking mechanism is configured in such a manner as not only to lock the piston but also to lock the operating part, so as to release the locked states of the piston and the operating part individually.

3. A paper bullet firing pistol toy as set forth in claim 1, wherein the piston is a circular cylindrical piston comprising one closed end as a piston head portion, a disk-shaped ring mounting plate being secured to the piston head portion, wherein the ring mounting plate is formed in such a manner that an outside diameter of a rear portion becomes smaller than a front portion, so that when secured to the piston head portion, a ring groove is formed between the piston head portion and the front portion of the ring mounting plate and includes a through hole communicating with the ring groove, and wherein an O ring is disposed slidably in the ring groove, whereby when the O ring is closely attached to the piston head portion, a space between the cylinder and the piston is sealed by the O ring, while when the O ring is closely attached to the front portion of the ring mounting plate, the space between the cylinder and the piston and the through hole are made to communicate with each other, so that air is allowed to flow into the space between the cylinder and the piston.

4. A paper bullet firing pistol toy as set forth in claim 2, wherein the piston is a circular cylindrical piston comprising one closed end as a piston head portion, a disk-shaped ring mounting plate being secured to the piston head portion, wherein the ring mounting plate is formed in such a manner that an outside diameter of a rear portion becomes smaller than a front portion, so that when secured to the piston head portion, a ring groove is formed between the piston head portion and the front portion of the ring mounting plate and includes a through hole communicating with the ring groove, and wherein an O ring is disposed slidably in the ring groove, whereby when the O ring is closely attached to the piston head portion, a space between the cylinder and the piston is sealed by the O ring, while when the O ring is closely attached to the front portion of the ring mounting plate, the space between the cylinder and the piston and the through hole are made to communicate with each other, so that air is allowed to flow into the space between the cylinder and the piston.

* * * * *